US009725794B2

(12) United States Patent
Trivedi et al.

(10) Patent No.: US 9,725,794 B2
(45) Date of Patent: Aug. 8, 2017

(54) CEMENTED CARBIDE ARTICLES AND APPLICATIONS THEREOF

(71) Applicant: Kennametal Inc., Latrobe, PA (US)

(72) Inventors: Pankaj B. Trivedi, Greensburg, PA (US); Pankaj Kumar Mehrotra, Greensburg, PA (US)

(73) Assignee: KENNAMETAL INC., Latrobe, PA (US)

( * ) Notice: Subject to any disclaimer, the term of this patent is extended or adjusted under 35 U.S.C. 154(b) by 176 days.

(21) Appl. No.: 14/573,893

(22) Filed: Dec. 17, 2014

(65) Prior Publication Data

US 2016/0177426 A1 Jun. 23, 2016

(51) Int. Cl.

| | |
|---|---|
| ***C22C 1/05*** | (2006.01) |
| ***C22C 29/08*** | (2006.01) |
| ***C22C 29/04*** | (2006.01) |
| ***C22C 29/00*** | (2006.01) |
| *B22F 5/00* | (2006.01) |

(52) U.S. Cl.

CPC ..... *C22C 29/08* (2013.01); *C22C 1/051* (2013.01); *C22C 29/005* (2013.01); *C22C 29/04* (2013.01); *B22F 2005/001* (2013.01)

(58) Field of Classification Search

USPC ..... 75/236, 240, 241, 242; 428/469, 698

See application file for complete search history.

(56) References Cited

U.S. PATENT DOCUMENTS 4,610,931 A * 9/1986 Nemeth ..... C22C 29/04 75/240
5,802,955 A 9/1998 Stoll
6,344,265 B1 2/2002 Blomstedt et al.
6,514,456 B1 2/2003 Lackner et al.
6,521,172 B2 * 2/2003 Grearson ..... C22C 29/08 419/18

(Continued)

FOREIGN PATENT DOCUMENTS

| | | |
|---|---|---|
| FR | 2350403 | * 12/1977 |
| GB | 1430432 A | 3/1976 |
| GB | 1499549 A | 2/1978 |

OTHER PUBLICATIONS

T.L. Shing, et al., The effect of ruthenium additions on the hardness, toughness and grain size.

(Continued)

*Primary Examiner* — Archene Turner

(74) *Attorney, Agent, or Firm* — Larry R. Meenan

(57) ABSTRACT

In one aspect sintered cemented carbide articles are described herein which, in some embodiments, exhibit enhanced resistance to wear and thermal fatigue. Further, sintered cemented carbide articles described herein can tolerate variations in carbon content without formation of undesirable phases, including eta phase and/or free graphite (C-type porosity). Such tolerance can facilitate manufacturing and use of carbide grades where carbon content is not strictly controlled. A sintered cemented carbide body described herein comprises a hard particle phase including tungsten carbide and a metallic binder phase comprising at least one of cobalt, nickel and iron and one or more alloying additives, wherein the sintered cemented carbide has a magnetic saturation (MS) ranging from 0% to 73% and no eta phase.

18 Claims, 1 Drawing Sheet

(56) References Cited

U.S. PATENT DOCUMENTS

| | | | | |
|---|---|---|---|---|
| 6,540,800 | B2 | 4/2003 | Sherman | |
| 6,866,921 | B2 * | 3/2005 | Grab | C22C 29/08 428/469 |
| 6,869,460 | B1 * | 3/2005 | Bennett | C22C 29/08 75/236 |
| 6,878,181 | B2 * | 4/2005 | Carpenter | C22C 29/08 75/240 |
| 6,929,851 | B1 * | 8/2005 | Leverenz | C23C 16/0236 428/469 |
| 7,244,519 | B2 | 7/2007 | Festeau et al. | |
| 7,846,551 | B2 | 12/2010 | Fang et al. | |
| 8,137,816 | B2 | 3/2012 | Fang et al. | |
| 8,512,882 | B2 | 8/2013 | Bost | |
| 8,790,439 | B2 | 7/2014 | Mirchandani et al. | |
| 2005/0072269 | A1 * | 4/2005 | Banerjee | C23C 30/005 75/240 |
| 2011/0286877 | A1 | 11/2011 | Gries | |
| 2012/0210822 | A1 * | 8/2012 | Konyashin | C22C 29/08 75/236 |
| 2013/0105231 | A1 | 5/2013 | Oakes | |
| 2013/0273382 | A1 | 10/2013 | Morton | |
| 2014/0246248 | A1 | 9/2014 | Eason | |

OTHER PUBLICATIONS

A.F. Lisovskii, Sintered Metals and Alloys.

J.H. Potgieter et al., Int. Journal of Refractory Metals and Hard Materials.

Anatolii F. Lisovskii, "Cemented Carbides Alloyed With Ruthenium, Osmium, and Rhenium", Powder Metallurgy and Metal Ceramics, vol. 39, Nos. 9-10, Sep. 2000, p. 428-433.

* cited by examiner

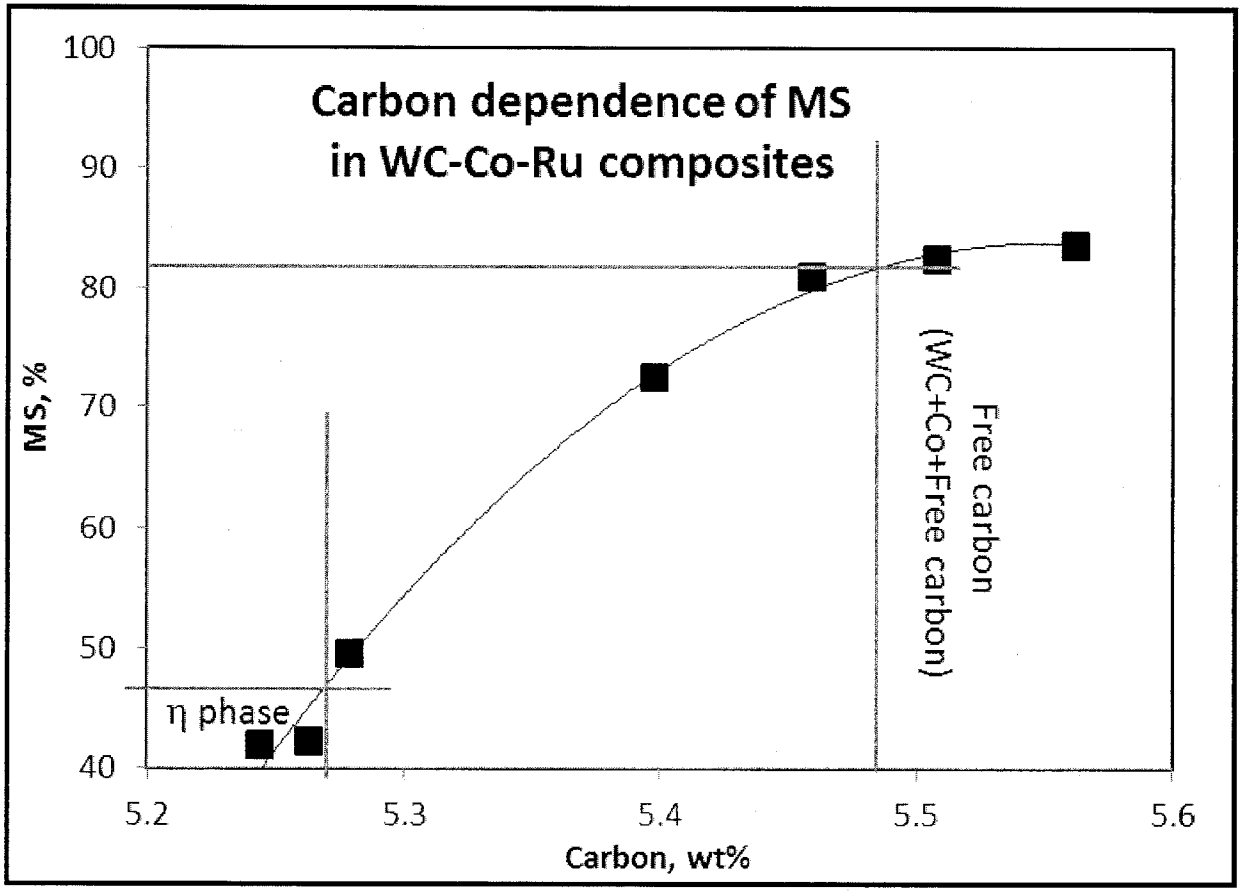
Carbon dependence of MS
in WC-Co-Ru composites
Free carbon
(WC+Co+Free carbon)
η phase
MS, %
100
90
80
70
60
50
40
5.2
5.3
5.4
5.5
5.6
Carbon, wt%

CEMENTED CARBIDE ARTICLES AND APPLICATIONS THEREOF

FIELD

The present invention relates to sintered cemented carbide articles and, in particular, to sintered cemented carbide articles having low magnetic saturation and no eta phase.

BACKGROUND

Sintered cemented carbide articles have been used in both coated and uncoated conditions for various tooling applications, such as cutting tools and wear parts. Increasing sintered cemented carbide resistance to wear and other failure modes including thermal fatigue, fracture and chipping, remains an intense area of research and development. To that end, significant resources have been assigned to the development of wear resistant refractory coatings for cutting tools. TiC, TiCN, TiOCN, TiN and $Al_2O_3$, for example, have been applied to cemented carbides by chemical vapor deposition (CVD) as well as physical vapor deposition (PVD).

Moreover, properties of the underlying cemented carbide substrates have been investigated. Cutting tool manufacturers have examined compositional changes to cemented carbide bodies and the resulting effects on cemented carbide properties including, but not limited to, hardness, wear resistance, thermal deformation resistance, toughness and density. Enhancement of one cemented carbide property, however, often results in the concomitant deterioration of another cemented carbide property. For example, increasing cemented carbide deformation resistance can result in decreased toughness and thermal conductivity. Nevertheless, improvements to cemented carbide bodies are necessary to meet the evolving demands of metal working applications, and a careful balance between competing properties is required when making compositional changes to cemented carbide bodies in efforts to provide cutting tools with improved performance.

SUMMARY

In one aspect sintered cemented carbide articles are described herein which, in some embodiments, exhibit enhanced resistance to wear and thermal fatigue. Further, sintered cemented carbide articles described herein can tolerate variations in carbon content without formation of undesirable phases, including eta phase and/or free graphite (C-type porosity). Such tolerance can facilitate manufacturing and use of carbide grades where carbon content is not strictly controlled. A sintered cemented carbide article described herein comprises a hard particle phase including tungsten carbide and a metallic binder phase comprising at least one of cobalt, nickel and iron and one or more alloying additives, wherein the sintered cemented carbide article has a magnetic saturation (MS) ranging from 0% to 73% and no eta phase. MS values recited herein are based on magnetic component(s) of the metallic binder phase. The alloying additive can comprise one or more metallic elements, nonmetallic elements or mixtures thereof. In some embodiments, the sintered cemented carbide article is carbon deficient. For example, carbon content of the sintered cemented carbide article can be 82% to 99.5% of the stoichiometric carbon content for the sintered cemented carbide article.

In another aspect, methods of making sintered cemented carbide articles are described herein. In some embodiments, a method described herein comprises providing a carbon deficient grade powder including a tungsten carbide phase and a metallic binder phase comprising at least one of cobalt, nickel and iron. An alloying additive is provided to the metallic binder phase of the grade powder, and the grade powder is consolidated into a green part. The green part is sintered to provide the sintered cemented carbide article having MS of 0% to 74% and no eta phase. Further, carbon content of the grade powder can be 82% to 99.5% of the stoichiometric carbon content for the grade powder.

These and other embodiments are described in greater detail in the detailed description which follows.

BRIEF DESCRIPTION OF THE DRAWINGS

FIG. 1 illustrates variation in MS with carbon content of sintered cemented carbide employing metallic binder with alloying additive according to some embodiments described herein.

DETAILED DESCRIPTION

Embodiments described herein can be understood more readily by reference to the following detailed description and examples and their previous and following descriptions. Elements, apparatus and methods described herein, however, are not limited to the specific embodiments presented in the detailed description and examples. It should be recognized that these embodiments are merely illustrative of the principles of the present invention. Numerous modifications and adaptations will be readily apparent to those of skill in the art without departing from the spirit and scope of the invention.

In one aspect sintered cemented carbide articles are described herein which, in some embodiments, exhibit enhanced resistance to wear and thermal fatigue. A sintered cemented carbide article described herein comprises a hard particle phase including tungsten carbide and a metallic binder phase comprising at least one of cobalt, nickel and iron and one or more alloying additives, wherein the sintered cemented carbide article has an MS ranging from 0% to 73% and no eta phase.

Turning now to specific components, the hard particle phase can be present in the sintered cemented carbide article in any amount not inconsistent with the objectives of the present invention. In some embodiments, for example, the hard particles phase is present in an amount of at least 70 weight percent or at least 80 weight percent of the sintered cemented carbide article. The hard particle phase can also be present in an amount selected from Table I.

TABLE I

| Hard Particle Phase Content Wt. % Sintered Cemented Carbide Article |
|---|
| 70-98 |
| 80-98 |
| 85-96 |
| 88-95 |
| 89-98 |
| 90-97 |

As described herein, the hard particle phase includes tungsten carbide. In some embodiments, the hard particle phase is formed solely of tungsten carbide. Alternatively, the hard particle phase can further include carbide, nitride and/or carbonitride of one or more metals selected from Groups IVB, VB and VIB of the Periodic Table. For example, in some embodiments, the hard particle phase comprises at least one of tantalum carbide, niobium carbide, vanadium carbide, chromium carbide, zirconium carbide, hafnium carbide, titanium carbide and solid solutions thereof in addition to tungsten carbide. Additional metal carbide, nitride and/or carbonitride can be present in the hard particle phase in any amount not inconsistent with the objectives of the present invention. In some embodiments, additional metal carbide, nitride and/or carbonitride is present in an amount of up to 50 wt. % of the hard particle phase. For example, additional metal carbide, nitride and/or carbonitride can be present in an amount of 1-10 wt. % of the hard particle phase.

Further, the hard particle phase can generally exhibit an average grain size less than 30 μm. For example, the hard particle phase can have an average grain size less than 10 μm or 5 μm, such as 0.5-3 μm.

As described herein, the sintered cemented carbide article includes a metallic binder phase comprising one or more alloying additives and the balance of cobalt, nickel and/or iron. Generally, the metallic binder phase is present in an amount of 1-30 wt. % of the sintered cemented carbide article. In some embodiments, metallic binder phase is present in an amount selected from Table II.

TABLE II

| Wt. % Metallic Binder of Sintered Cemented Carbide |
|---|
| 1-30 |
| 2-20 |
| 2-12 |
| 3-10 |
| 4-15 |
| 10-30 |

Alloying additive of the metallic binder phase comprises one or more metallic elements, non-metallic elements or solid solutions thereof. Metallic elements suitable for use as alloying additive include transition metals and aluminum. In some embodiments, transition metal alloying additive is selected from Groups IIIB-VIIIB of the Periodic Table. For example, alloying additive can comprise one or more of tungsten, ruthenium, manganese, copper, rhenium, chromium, osmium and molybdenum. In some embodiments, metallic alloying additive exhibits a hexagonal close-packed (hcp) crystalline structure. In other embodiments, metallic alloying additive has a cubic crystalline structure, such as face-centered cubic (fcc) or body-centered cubic (bcc). Alloying additive can also include one or more non-metallic elements. Non-metallic alloying elements can selected from Groups IIIA-VA of the Periodic Table, such as boron, silicon, carbon and/or nitrogen.

Alloying additive can be present in the metallic binder phase in any amount operable to provide the sintered cemented carbide article low magnetic saturation values described herein without the formation of eta phase. Generally, alloying additive is present in an amount up to 50 wt. % of the metallic binder phase. In some embodiments, for example, alloying additive is present in an amount of 10-30 wt. % or 30-50 wt. % of the metallic binder phase.

In some embodiments, a sintered cemented carbide article described herein further comprises a surface zone of alloy binder enrichment having maximum alloy binder content greater than the alloy binder content in the bulk of the sintered article. The zone of binder enrichment can extend inwardly from the sintered article surface. In some embodiments, alloy binder of the enrichment zone is stratified, exhibiting distinct layers of alloy binder. In other embodiments, the alloy binder is non-stratified. The sintered cemented carbide article can exhibit a surface zone of alloy binder enrichment on one or multiple surfaces.

Sintered cemented carbide articles having composition described herein can exhibit MS of 0% to 73%. Importantly, the sintered cemented carbide articles do not exhibit eta phase, (CoW)C type phases, at these low MS values. In some embodiments, sintered cemented carbide articles having composition described herein exhibit MS selected from Table III.

TABLE III

| MS of Sintered Cemented Carbide Article |
|---|
| 0-73 |
| 0-70 |
| 3-73 |
| 5-70 |
| 15-60 |
| 20-65 |
| 30-65 |
| 40-65 |

Magnetic saturation values recited herein are based on magnetic component(s) of the metallic binder phase and are determined according to ASTM B 886-12, "Standard Test Method for Determination of Magnetic Saturation (MS) of Cemented Carbides," ASTM International. As known to one of skill in the art, magnetic saturation values may be converted from percentages to $\mu Tm^3/kg$ or other comparable units based on comparison to a nominally pure Co binder phase. For example, see Roebuck, B. Magnetic Moment (Saturation) Measurements on Hardmetals, *Int. J. Refractory Metals & Hard Materials,* 14 (1996) 419-424. Additionally, sintered cemented carbide articles described herein can exhibit hardness of at least 80 HRA. In some embodiments, a sintered cemented carbide article has hardness of 80-94 HRA.

Sintered cemented carbide articles of composition described herein and having the foregoing MS and no eta phase can be carbon deficient. For example, carbon content of the sintered cemented carbide article can be 82% to 99.5% of the stoichiometric carbon content for the sintered article. As detailed in the examples below, stoichiometric carbon content is dependent on specific compositional parameters of the sintered cemented carbide article and, therefore, can vary between sintered cemented carbide articles formed of differing grade powders. In some embodiments, carbon content of the sintered cemented carbide article relative to stoichiometric carbon content is selected from Table IV.

TABLE IV

| Carbon Content of Sintered Cemented Carbide Article % of Stoichiometric Carbon Content for Sintered Cemented Carbide Article |
|---|
| 85-99.5 |
| 90-99.5 |
| 82-99 |
| 85-99 |
| 90-99 |
| 94-99 |
| 82-98 |
| 85-98 |
| 90-98 |
| 94-98 |

Such tolerance to variations in carbon content without the formation of eta phase and/or other lower carbides, such as $W_2C$, can facilitate manufacturing and use of carbide grades and sintering conditions where carbon content is not strictly controlled. In some embodiments, a carbon deficient sintered cemented carbide body has MS of 0% to 74% and no eta phase.

Methods of fabricating sintered cemented carbide articles are described herein employing carbon deficient grade powders. For example, a method described herein comprises providing a carbon deficient grade powder including a tungsten carbide phase and a metallic binder phase comprising at least one of cobalt, nickel and iron. An alloying additive is provided to the metallic binder phase of the carbon deficient grade powder, and the carbon deficient grade powder is consolidated into a green part. The green part is sintered to provide the sintered cemented carbide article having MS of 0% to 74% and no eta phase. In some embodiments, the sintered cemented carbide article has an MS value selected from Table III hereinabove.

Additionally, carbon content of the grade powder can be 82% to 99.5% of the stoichiometric carbon content for the grade powder. In some embodiments, carbon content of the grade powder relative to stoichiometric carbon content is consistent with values provided in Table IV above. Sintered cemented carbide articles produced according to the present method can have any composition and/or properties recited hereinabove, including the carbon deficiencies provided in Table IV.

Powder alloying additive can be provided to the grade powder and milled or otherwise intimately mixed with the grade powder such that the tungsten carbide particles are in contact with powder metallic binder including the alloying additive. Alternatively, the metallic binder phase of the grade powder is prealloyed with the alloying additive. For example, powder metallic binder of the grade composition can be an alloy formed of cobalt and alloying additive. In some embodiments, the grade powder composition further comprises carbide, nitride and/or carbonitride of one or more metals selected from Groups IVB, VB and VIB of the Periodic Table. For example, in some embodiments, the grade powder includes particles of tantalum carbide, niobium carbide, vanadium carbide, zirconium carbide, hafnium carbide, chromium carbide and/or titanium carbide in addition to the tungsten carbide.

The green part of consolidated grade powder can be sintered under any conditions not inconsistent with the objectives of the present invention to provide a cemented carbide article described herein. For example, the green part or compact can be vacuum sintered or sintered-hot isostatic press (HIP) at a temperature ranging from 1350° C. to 1560° C. for a time period sufficient to produce the desired density and microstructure.

In some embodiments, sintered cemented carbide articles having composition and properties described herein are coated with one or more refractory materials by PVD and/or CVD. In some embodiments, the refractory coating comprises one or more metallic elements selected from aluminum and metallic elements of Groups IVB, VB and VIB of the Periodic Table and one or more non-metallic elements selected from Groups IIIA, IVA, VA and VIA of the Periodic Table. For example, the refractory coating can comprise one or more carbides, nitrides, carbonitrides, oxides or borides of one or more metallic elements selected from aluminum and Groups IVB, VB and VIB of the Periodic Table. Additionally, the coating can be single-layer or multi-layer.

Further, surfaces of sintered cemented carbide articles described herein can be subjected to one or more treatments such as polishing, blasting and/or etching. The surface treated sintered cemented carbide articles can remain in the uncoated state or a refractory coating described herein can be applied to the treated surfaces. Moreover, one or more layers of the refractory coating can be subjected a post-coat treatment such as polishing and/or blasting.

Sintered cemented carbide articles having compositions and properties described herein can exhibit enhanced resistance to wear and thermal fatigue without meaningful drop in toughness. The sintered cemented carbide articles are, therefore, suitable for a number of tooling applications. In some embodiments, sintered cemented carbide articles described herein are cutting tools. For example, sintered cemented carbide articles can be end mills, drills or cutting inserts, including indexable cutting inserts. Sintered cemented carbide articles described herein may also be tooling for earth-boring applications, such as bit bodies, fixed cutter blades and/or rotating cutter blades. Further, the sintered cemented carbide articles can be employed in molding applications as molds, dies and/or extruder parts.

These and other embodiments are further illustrated by the following non-limiting examples.

Example 1—Sintered Cemented Carbide Articles

Sintered cemented carbide articles having the compositions set forth in Table V were provided as follows. Grade powder of 89 wt. % tungsten carbide particles having an average grain size less than 5 μm, 9.5 wt. % powder cobalt binder and 1.5 wt. % powder ruthenium alloying additive was vacuum sintered at a peak temperature of 1395° C. to provide the fully dense cemented carbide compositions. Tungsten metal powder (TMP) was added to the grade powder compositions in the percentages of Table V to render the grade powder carbon deficient. Additionally, carbon was added to the grade powder of Sample 6 to determine the formation of C-porosity. Actual carbon content for each sintered cemented carbide article was compared to the stoichiometric carbon content for the sintered article. As Samples 1-6 employed WC as the sole carbide phase, stoichiometric carbon content was determined using the theoretical stoichiometric carbon content of 6.13 wt. % for WC. Examination of eta phase was conducted by grinding each sintered cemented carbide article as-needed, followed by final polishing using 1 micron Petrodisk polishing wheel. The quality of the polished surface was checked with an optical microscope at a magnification of 200×-500×. Repolishing was administered if needed. The polished surface was etched using Murakami's etching solution for a minimum of three seconds. The etched surface was examined for eta phase using an optical microscope at 150× magnification.

TABLE V

Sintered Cemented Carbide Articles

| WC-9.5%Co-1.5%Ru Sample | TMP Added wt. % | Carbon added wt. % | Measured MS % | Eta phase C-porosity | HRA | Measured carbon content wt. % | Total W content wt. % | Stoich. carbon content Wt. % | % Stoich. carbon content |
|---|---|---|---|---|---|---|---|---|---|
| 1 | 3.42 | 0 | 41.97 | Eta | 90.1 | 5.244 | 92.42 | 5.665 | 92.56 |
| 2 | 2.92 | 0 | 42.24 | Eta | 90.1 | 5.263 | 91.92 | 5.634 | 93.40 |
| 3 | 2.43 | 0 | 49.56 | None | 89.8 | 5.279 | 91.43 | 5.605 | 94.19 |
| 4 | 0.92 | 0 | 72.57 | None | 89.7 | 5.398 | 89.92 | 5.512 | 97.93 |

TABLE V-continued

| Sintered Cemented Carbide Articles | | | | | | | | | |
|---|---|---|---|---|---|---|---|---|---|
| WC-9.5%Co-1.5%Ru Sample | TMP Added wt. % | Carbon added wt. % | Measured MS % | Eta phase C-porosity | HRA | Measured carbon content wt. % | Total W content wt. % | Stoich. carbon content Wt. % | % Stoich. carbon content |
| 5 | 0 | 0 | 80.94 | None | 89.7 | 5.459 | 89.00 | 5.456 | 100.06 |
| 6 | 0 | 0.07 | 82.47 | C-porosity | 89.8 | 5.508 | 89.00 | 5.456 | 100.96 |

The results detailed in Table V are graphically illustrated in FIG. 1. The ruthenium alloying additive resulted in low MS values and significantly enhanced the range over which no eta phase was formed. Additionally, presence of the ruthenium alloying additive permitted use of tungsten carbide having substantial carbon deficiency without the formation of eta phase. Therefore, tungsten carbide raw-material with wider carbon distributions can be successfully employed in the fabrication of cemented carbide articles without the presence of eta phase and/or C-porosity. Importantly, as set forth in Table V, the amount of ruthenium alloying additive remained constant over Samples 1-6. In some embodiments, additional alloying additive may be added to Samples 1-2 resulting in elimination of the eta phase and further reduction of the MS as described herein.

Various embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the invention.

The invention claimed is:

1. A sintered cemented carbide article comprising:

a hard particle phase including tungsten carbide, wherein the hard particle phase is carbon deficient; and a metallic binder phase comprising at least one of cobalt, nickel and iron and one or more metallic alloying additives, wherein the sintered cemented carbide article has a magnetic saturation (MS) ranging from 0% to 73% and no eta phase.

2. The sintered cemented carbide article of claim 1, wherein the hard particle phase further comprises carbide, nitride or carbonitride of one or more metals selected from Group IVB, VB or VIB of the Periodic Table.

3. The sintered cemented carbide article of claim 2, wherein the hard particle phase comprises at least one of tantalum carbide, niobium carbide, vanadium carbide, chromium carbide, zirconium carbide, hafnium carbide, titanium carbide and solid solutions thereof.

4. The sintered cemented carbide article of claim 1, wherein the alloying additive comprises one or more metallic elements.

5. The sintered cemented carbide article of claim 4, wherein the metallic elements are transition metals.

6. The sintered cemented carbide article of claim 5, wherein the transition metals are selected from Groups IIIB-VIIIB of the Periodic Table.

7. The sintered cemented carbide article of claim 6, wherein the transition metals are selected from the group consisting of tungsten, ruthenium, manganese, copper, rhenium, chromium, osmium and molybdenum.

8. The sintered cemented carbide article of claim 1, wherein the alloying additive is present in an amount up to 50 wt. % of the metallic binder phase.

9. The sintered cemented carbide article of claim 8, wherein the alloying additive comprises ruthenium.

10. The sintered cemented carbide article of claim 1, wherein the MS ranges from 5% to 65%.

11. The sintered cemented carbide article of claim 1, wherein the MS ranges from 40% to 65%.

12. The sintered cemented carbide article of claim 1, wherein the metallic binder is present in an amount of 1 to 30 wt. % of the sintered cemented carbide article.

13. The sintered cemented carbide article of claim 1, wherein carbon content of the hard particle phase of the sintered cemented carbide article is 82% to 99.5% of stoichiometric carbon content for the hard particle phase of the sintered cemented carbide article.

14. The sintered cemented carbide article of claim 1, wherein carbon content of the hard particle phase of the sintered cemented carbide article is 90% to 98% of stoichiometric carbon content for the hard particle phase of the sintered cemented carbide article.

15. The sintered cemented carbide article of claim 1 further comprising a metallic binder enriched zone at a surface of the article.

16. The sintered cemented carbide article of claim 1, wherein the alloying additive is present in an amount of 30-50 wt. % of the metallic binder phase.

17. The sintered cemented carbide article of claim 1, wherein the hard particle phase has an average grain size of 0.5 μm to 3 μm.

18. The sintered cemented carbide article of claim 1, wherein the MS ranges from 3% to 73%.

* * * * *